US011746776B2

(12) United States Patent
Kutella

(10) Patent No.: US 11,746,776 B2
(45) Date of Patent: Sep. 5, 2023

(54) BI-DIRECTIONAL BILGE PUMP

(71) Applicant: James D. Kutella, Lake Oswego, OR (US)

(72) Inventor: James D. Kutella, Lake Oswego, OR (US)

(73) Assignee: James D. Kutella, Lake Oswego, OR (US)

( * ) Notice: Subject to any disclaimer, the term of this patent is extended or adjusted under 35 U.S.C. 154(b) by 749 days.

(21) Appl. No.: 15/158,244

(22) Filed: May 18, 2016

(65) Prior Publication Data

US 2017/0335843 A1 Nov. 23, 2017

(51) Int. Cl.

| | |
|---|---|
| ***F04B 53/10*** | (2006.01) |
| ***F04B 19/22*** | (2006.01) |
| ***F04B 53/14*** | (2006.01) |
| ***F04B 53/16*** | (2006.01) |
| ***F04B 15/00*** | (2006.01) |
| ***F04B 9/14*** | (2006.01) |

(52) U.S. Cl.

CPC ..... *F04B 53/1002* (2013.01); *F04B 9/14* (2013.01); *F04B 15/00* (2013.01); *F04B 19/22* (2013.01); *F04B 53/101* (2013.01); *F04B 53/14* (2013.01); *F04B 53/16* (2013.01)

(58) Field of Classification Search

CPC ..... F04B 9/14; F04B 53/126; F04B 53/1007
USPC ..... 417/554
See application file for complete search history.

(56) References Cited

U.S. PATENT DOCUMENTS

| | | | | |
|---|---|---|---|---|
| 1,746,524 A * | 2/1930 | Corson | B05B 9/0877 | 222/385 |
| 2,137,402 A * | 11/1938 | Hoferer | F04B 53/1007 | 137/533.15 |
| 2,354,265 A * | 7/1944 | Horvath | A62C 11/005 | 222/530 |
| 3,906,845 A * | 9/1975 | Wegmann | F16J 15/185 | 417/554 |
| 4,265,375 A * | 5/1981 | Flider | B67D 7/60 | 222/189.01 |

* cited by examiner

*Primary Examiner* — Alexander B Comley
(74) *Attorney, Agent, or Firm* — Chernoff, Vilhauer, McClung & Stenzel, LLP

(57) ABSTRACT

A pump with an outer housing defining an enclosure, an inlet for admitting fluid into the outer housing and an outlet for expelling fluid from the outer housing, a piston for selectively modulating a first fluid pressure, such that the first fluid pressure is associated with a location proximate the inlet, and a member that selectively isolates a second pressure associated with a location proximate the outlet from the first fluid pressure. The pump may also include a first chamber within the outer housing for receiving fluid admitted into the pump from an ambient environment and through an inlet to the pump, a second chamber within the outer housing for receiving fluid from the first chamber, and a piston that both (i) selectively controls the flow of fluid from the first chamber to the second chamber and (ii) selectively expels the fluid from the second chamber into the ambient environment.

5 Claims, 3 Drawing Sheets

BI-DIRECTIONAL BILGE PUMP

BACKGROUND

Operation of watercraft frequently requires the use of bilge pumps, which are used to remove the accumulated water from within the watercraft. Bilge pumps therefore help to both keep watercraft dry and prevent them from sinking. They may also be helpful in other applications in which fluid has accumulated and needs to be removed, such as in plumbing and irrigation situations.

In traditional bilge pumps, fluid is drawn into a pump through an inlet by retracting a plunger within a pump chamber and an outlet that expels the fluid from the watercraft when the plunger is pulled up into the pump chamber. Typically, the inlet has a valve that ensures that fluid does not flow back out through the inlet when the plunger is pushed down into the chamber. The plunger also includes a plunger valve with a flexible flap that only allows fluid to pass as the plunger is pushed down, and prevents fluid to pass as the plunger is pulled up. Fluid is only expelled through the outlet as the plunger is retracted and thereby pulled up the pump chamber.

Bilge fluid often includes other solid and semi-solid debris, such as sticks and leaves, which frequently plug up traditional pumps. If debris is drawn into the inlet as the plunger is retracted, the debris accumulates around the plunger valve and thereby prevents fluid from passing through the valve as the plunger is pushed down. Such pumps are also frequently not capable of being taken apart to allow for removal of the accumulated debris.

A better bilge pump mechanism is needed to avoid the problem of current bilge pumps, which are constructed with easily clogged valves, thereby inhibiting bilge removal over time.

The foregoing and other objectives, features, and advantages of the devices and mechanisms disclosed herein will be more readily understood upon consideration of the following detailed description of the devices and mechanisms taken in conjunction with the accompanying drawings.

BRIEF DESCRIPTION OF THE SEVERAL DRAWINGS

DETAILED DESCRIPTION

Figure 1:
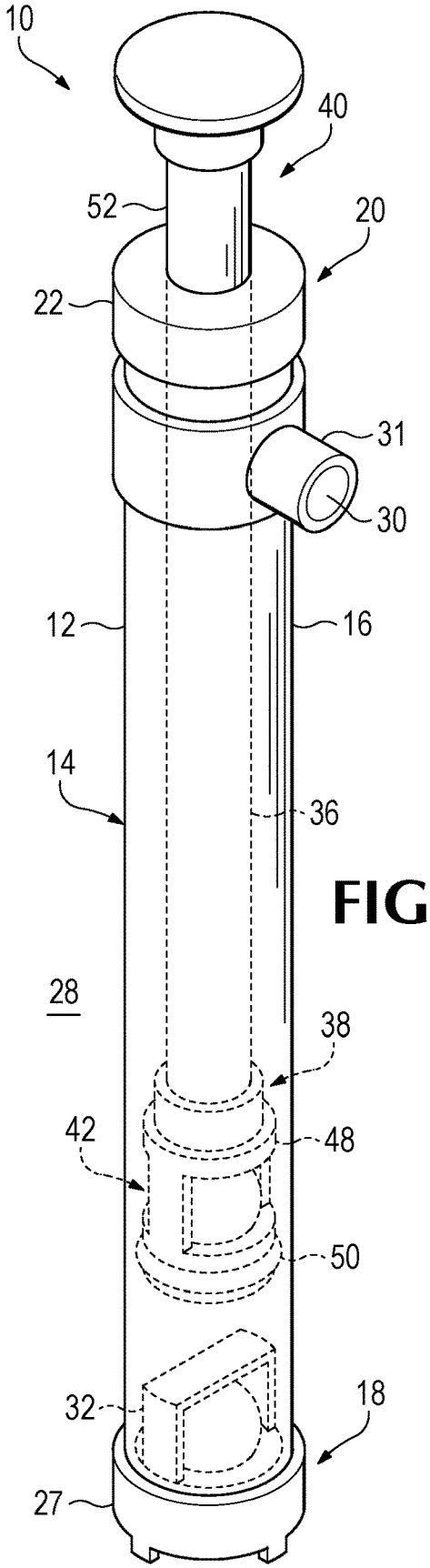
FIG. 1 is an isometric view of the pump from a position above the pump.

Traditional bilge pumps are ineffective because they are easily clogged with debris drawn into a pump. Existing pumps have inlet and plunger valves that each only allow fluid to pass in one direction. The plunger valve is often a small flexible flap constructed to only provide passage for fluid and separates a lower and upper compartment of the pump. In other words, fluid is drawn into a traditional pump through an inlet valve as a plunger is pulled up into the pump body, by reducing the pressure within the pump body. To expel the fluid drawn into the pump, the plunger is pushed back into the pump body, whereby the pressure in the pump body is increased and thus opens the plunger valve and forces fluid into the upper compartment of the pump. Then the plunger is pulled back up, closing the plunger valve expelling the fluid in the upper compartment out of an outlet. Fluid is therefore only expelled when the plunger is pulled upward. When debris comes in through the inlet of a traditional bilge pump, it clogs the plunger valve such that the debris often accumulates and inhibits further pumping.

The inventor realized that pressures at the inlet and the outlet could be isolated from each other by designing a secondary chamber within the pump by which fluid first is drawn into the pump into a first chamber, then into the secondary chamber, which is isolated from the inlet. Then the fluid is pumped out and flows from the secondary chamber and out of the pump through the outlet. In so designing, fluid is pumped out of the outlet during both the upward and downward strokes of the pumping action. Also, in one embodiment, the device may include two ball valves, one between the pump inlet and the first chamber, and one that separates the first chamber with the secondary chamber.

Using such ball valves facilitates passage of any withdrawn solid and semi-solid debris because all of the openings or apertures are larger and/or not impeded by structural impedances, wherein such impedances are associated with traditional bilge pumps. Due to the minimized structural impedance, the pumped bilge fluid passes through the pump with decreased resistance therefore requiring less physical effort to pump, as compared to traditional bilge pumps. Also, the mechanism of which will be later described in detail, an embodiment of the present invention provides for expelling fluid both as a piston is pulled away from the inlet and as it is pushed toward the inlet, whereas traditional bilge pumps only expel fluid as the piston is pulled away from the inlet. In an embodiment of the invention, which combines the minimized structural impedance and the bi-directional pumping capability, a volume of bilge fluid can be pumped in less time and with less physical expenditure by the user than if a traditional bilge pump were used.

In one embodiment, this device relates to a pump with an outer housing defining an enclosure, an inlet for admitting fluid into the outer housing and an outlet for expelling fluid from the outer housing, a piston for selectively modulating a first fluid pressure, such that the first fluid pressure is associated with a location proximate said inlet, and a member that selectively isolates a second pressure associated with a location proximate the outlet from said first fluid pressure.

In another embodiment, this device relates to a pump with an outer housing defining an enclosure, a first chamber within the outer housing for receiving fluid admitted into the pump from an ambient environment and through an inlet to said pump, a second chamber within the outer housing for receiving fluid from the first chamber, and a piston that both (i) selectively controls the flow of fluid from the first chamber to the second chamber and (ii) selectively expels said fluid from the second chamber into the ambient environment.

In yet another embodiment, this device relates to a pump with an outer housing defining an enclosure, an inlet for admitting fluid into the outer housing and an outlet for expelling fluid from the outer housing, and a piston capable of a first directional movement and a second directional movement different than the first directional movement, where the fluid is admitted into the outer housing and expelled from the outer housing during said first directional movement, and the fluid is expelled from the outer housing but not admitted into the outer housing during the second directional movement.

Figure 2:
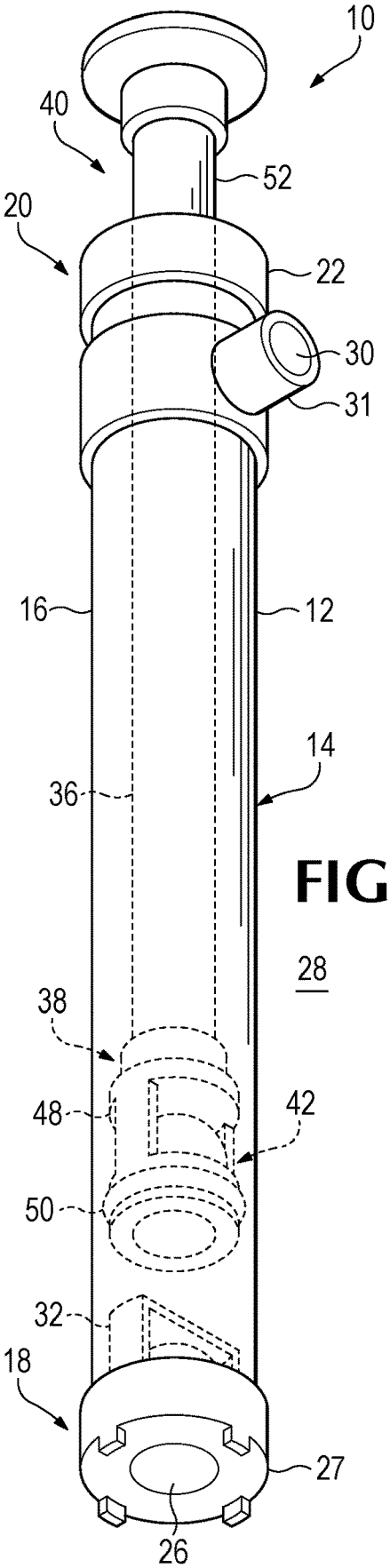
FIG. 2 is an isometric view of the pump from a position below the pump.

Referring to the FIG. 1, for example, an exemplarily pump 10 may include an outer housing 12, which defines an enclosure 14. FIGS. 1 and 2 show one embodiment of the pump 10, where the outer housing 12 takes the form of an elongate chamber 16 having a first end 18 and a second end 20. In the embodiment shown in FIG. 1, the elongate chamber 16 has a cylindrical shape. However, it may take other forms depending on manufacturing requirements. Materials that may be used to manufacture the pump include, but are not limited to, polyvinyl chloride (PVC), acrylonitrile butadiene styrene (ABS), santoprene, acetal, and nitrile.

The enclosure 14 is bounded by an inner wall 24 and the first and second ends 18, 20 of the enclosure 14 or the elongate chamber 16. The second end 20 may be sealed with a top 22, configured to both seal the second end 20 and provide a moveable seal with a piston stem 52, as will be later described in more detail.

As best viewed in FIG. 2, an inlet 26 for admitting fluid into the outer housing 12 from the ambient environment 28 is located at the first end 18 of the elongate chamber 16. In the embodiment shown in FIG. 2, the inlet has a circular shape and is part of a pump stand 27. However, the inlet may take the form of any shape and may not be associated with a pump stand 27. The stand 27 may be included to aid in stable and upright storage of the pump 10. In some embodiments, the inlet 26 may be a group of smaller inlets, used to prevent larger items from entering the inlet 26 from the ambient environment 28. In the embodiment shown, the inlet 26 is a single opening to permit passage of potential debris. As viewable in FIGS. 3-6, the pump stand 27 is structurally associated with the primary check valve 32 or 34.

The pump 10 may also include an outlet 30 for expelling fluid from the outer housing 12. In the embodiment shown in FIGS. 1 and 2, the outlet 30 is located proximate the second end of the elongate chamber 22. The outlet 30 may be a hole in the side of the elongate chamber 16. The outlet 30 may be of sufficient size to reduce the accumulation of debris at the outlet 30, or to otherwise reduce resistance to pumping out fluid. In the embodiment shown herein, the outlet 30 is configured with an additional spout 31, which may aid in directing expelled fluid away from the pump 10.

In one embodiment of the present device, a primary check valve 32 is located adjacent the inlet 26 and associated with the pump stand 27, such that any fluid and possible debris that enters the inlet 26 from the ambient environment 28 enters the enclosure 14 through the primary check valve 32. In an embodiment of the device shown in FIGS. 1-5, the primary check valve 32 is a ball valve. However, other types of check valves may be used as the primary check valve 32. For example, in the embodiment of a portion of the pump 10 shown in FIG. 6, the primary check valve is a relief valve 34. A benefit of using a ball valve 32, however, is that when open, a ball valve provides both a flexible and large opening for the passage, and therefore pumping, of debris. The ball portion of a ball valve 32 is able to adjust its position to allow for the passage of debris. This advantage avoids the problem of clogs in other bilge pumps because such debris is pumped through the bilge pump along with the fluid. Also, when open, ball valves provide less resistance to the pumping of fluid, allowing a user to pump fluid more easily.

A function of the primary check valve 32 is to allow fluid to enter through the inlet 26, past the primary check valve 32, and into the enclosure 14, while preventing any fluid from exiting the enclosure 14 though the inlet 26. The primary check valve 32 responds to changes in surrounding pressure, as will be described in more detail later in the disclosure.

The piston 36 shown herein has a first end 38 and a second end 40. The first end 38 includes a member 42 that selectively isolates a first chamber 58, associated with a first fluid pressure 44, from a second chamber 60, associated with second fluid pressure 46. The volume of the first chamber 58 changes with respect to the volume of the second chamber 60, thereby changing the corresponding fluid pressures 44, 46.

Figure 3:
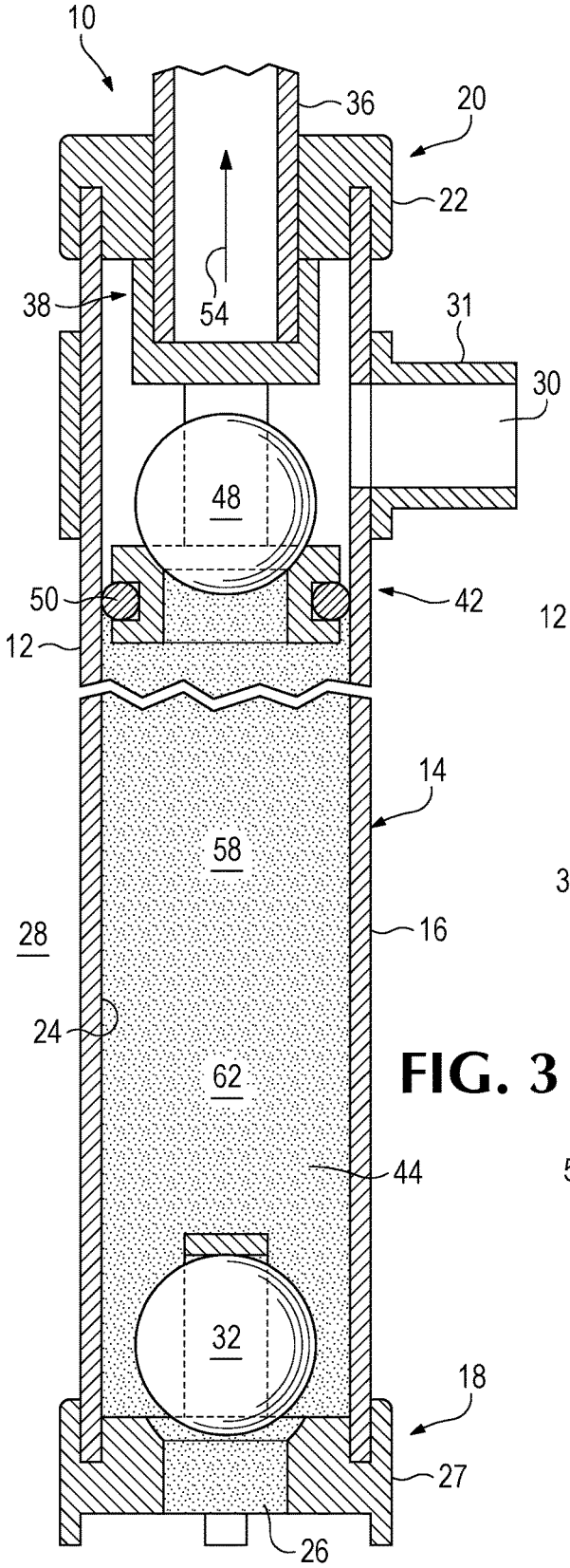
FIG. 3 is a sectional view of the pump in a first operative position.
Figure 4:
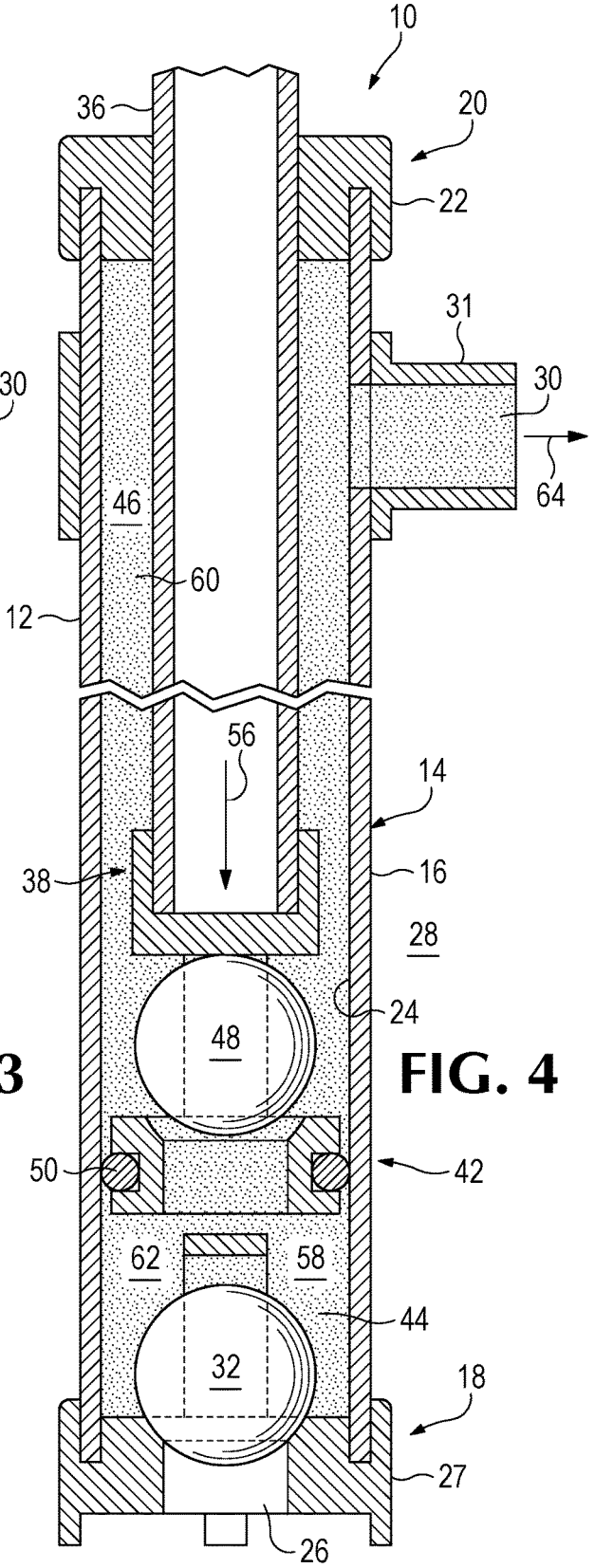
FIG. 4 is a sectional view of the pump in a second operative position.

In this embodiment of the present device, the piston 36 includes an elongate stem or handle 52, which extends out of the second end of the elongate chamber 20. The stem 52 is moveably sealed to the top 22 of the pump 10. The volume of fluid that can be retained in the second chamber 60 when the piston is the position pushed all the way to the end of the chamber, as shown in FIG. 4, in an exemplary embodiment, may be half of the volume of the fluid drawn in during a first directional movement 54, as shown in FIG. 3. When the piston 36 is pushed all the way down as shown in FIG. 4, one half of the fluid remains in the second chamber 60, and the other half is expelled through the outlet, shown by arrow 64. In one embodiment of the device, the inner radius $R_1$ of the elongate chamber and the radius $R_2$ have the following relationship: $R_1=[(2*R_2^2)^{1/2}]$. Such a relationship may be beneficial to maximize the amount of fluid pumped with each manual stroke.

The member 42 includes a secondary check valve 48 and a seal 50. The piston 36 and the seal 50 effectively isolates the first fluid pressure 44 from the second fluid pressure 46, thereby dividing the enclosure 14 into a first chamber 58 and a second chamber 60. The secondary check valve 48 shown in FIGS. 1-5 is a ball valve. However, other types of check valves may be used depending on manufacturer's preference. The piston 36 functions to modulate a first fluid pressure, indicated generally at 44, such that the first fluid pressure 44 is proximate to the inlet 24. The piston 36 may be moved in a first directional movement 54 and a second directional movement 56. The secondary check valve 48 functions to allow fluid to pass from the first chamber 58 to the second chamber 60. Therefore, the secondary check valve 48 can be in an open or closed position, depending on the first and second fluid pressures 44, 46.

Figure 5:
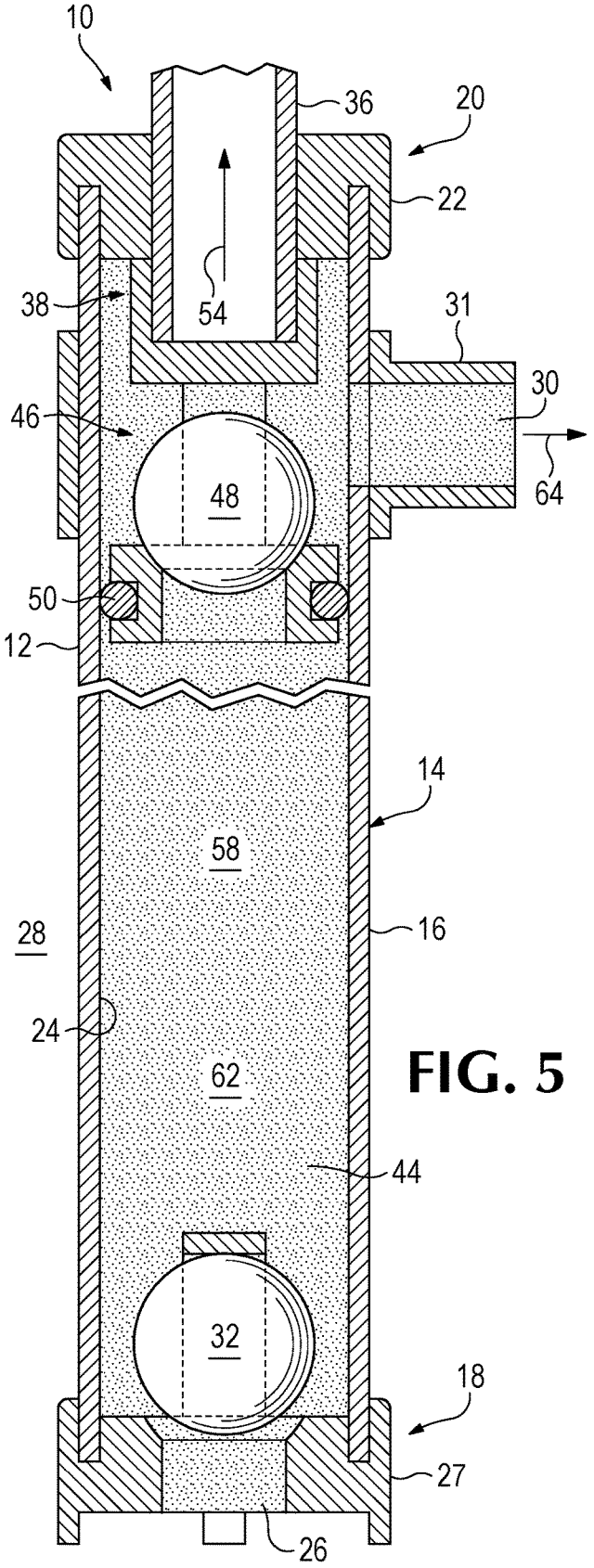
FIG. 5 is a sectional view of the pump in a third operative position.
Figure 6:
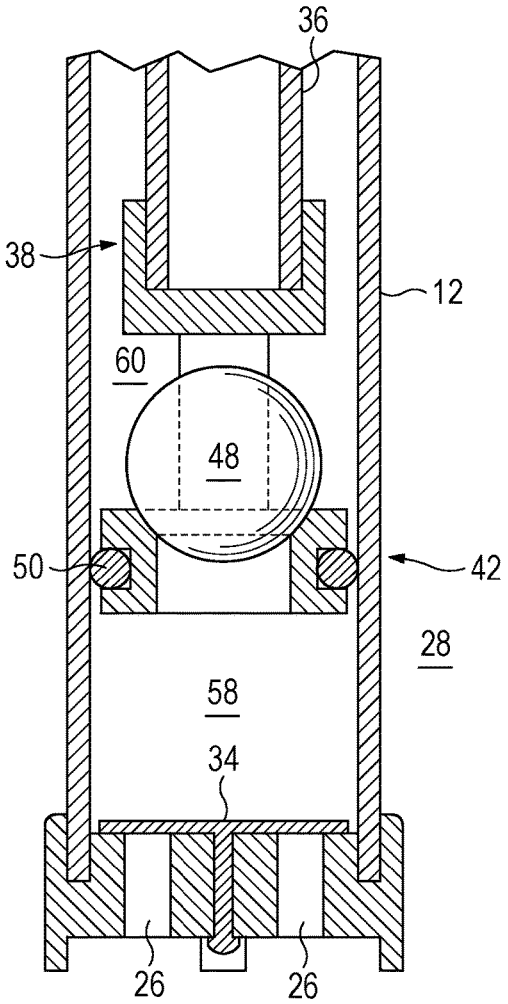
FIG. 6 is a sectional view of an alternative embodiment of a portion of the pump.

FIGS. 3-5 exemplify how the pump is used such that fluid can be pumped out of the outlet 30 as the piston 36 is moved in both the first directional movement 54 and the second directional movement 56. Prior to pumping fluid, the first end of the piston 38 should be pushed proximate to the first end of the empty elongate chamber 18 (this configuration is not shown). To begin pumping, stem 52 may be gripped to pull the piston 36 in the first directional movement 54. In doing so, the first fluid pressure 44 decreases, which thereby opens the primary check valve 32 and closes the secondary check valve 48. Fluid 62 is admitted from the ambient environment 28 through the inlet 26, into the first chamber 58, until the top of the secondary check valve 48 reaches the second end of the elongate chamber 20, as shown in FIG. 3. At this point, a volume of fluid has been pumped into the enclosure 14. At this static condition, the first fluid pressure 44 forces the primary check valve 32 to close, thereby preventing any fluid escape out of the inlet 26.

When the piston 36 is urged in the second directional movement 56, as shown in FIG. 4, the first fluid pressure 44 is increased, thereby keeping the primary check valve 32 closed and opening the secondary check valve 48. Open secondary check valve 48 allows fluid 62 to enter through the valve from the first chamber 58 to the second chamber 60, thereby reducing the volume of the first chamber 58 and maximizing the volume of the second chamber 60. Because the volume of the piston 36 is about half of the volume of the enclosure 14, the piston 36 displaces about half of the fluid 62, the second chamber 60 retains about half of the fluid traveling from the first chamber 58 to the second chamber 60. The additional half of fluid 62 is expelled through the outlet 30, as demonstrated in FIG. 4 at 64.

FIG. 5 shows a step following FIG. 4 wherein the piston 36 is urged in the first direction 54. During this step, the remaining half of fluid 62 in the second chamber 60 is expelled through the outlet 30 at 64. Fluid 62 is concurrently admitted through the inlet 26, the same way as described with FIG. 3. Following this step, the piston 36 is pushed down toward the second end of the elongate chamber 20, and half of the admitted fluid that is ejected. As such, with each single-direction movement or stroke of the piston 36, half of the volume of the initially-admitted fluid 62 is ejected.

The terms and expressions that have been employed in the foregoing specification are used therein as terms of description and not of limitation, and there is no intention in the use of such terms and expressions of excluding equivalents of the features shown and described or portions thereof, it being recognized that the scope of the device is defined and limited only by the claims that follow.

What is claimed is:

1. A pump comprising:

(a) an outer housing defining an enclosure;

(b) an inlet for admitting fluid into said outer housing and an outlet for expelling fluid from said outer housing;

(c) a plunger for selectively modulating a first fluid pressure, said first fluid pressure associated with a first chamber proximate said inlet; and (d) a valve that selectively isolates a second fluid pressure from said first fluid pressure, said second fluid pressure associated with a second chamber surrounding the plunger and separated from the first chamber by the valve, the valve having a moving ball with a peripheral surface that defines both a valve entrance for fluid and debris to enter the valve from the first chamber and a valve exit for fluid and debris to escape the valve into the second chamber.

2. The pump of claim 1, wherein there is no valve at said outlet.

3. The pump of claim 1 further comprising a seal for the valve.

4. The pump of claim 1, wherein said first fluid pressure controls fluid uptake through said inlet.

5. The pump of claim 1, wherein the outer housing comprises an elongate chamber having a first end and a second end.

* * * * *